US008267255B2

(12) United States Patent
Kinuta

(10) Patent No.: US 8,267,255 B2
(45) Date of Patent: Sep. 18, 2012

(54) SIEVE, SIFTING DEVICE, SOLDER BALLS, AND METHOD OF SIFTING SPHERICAL PARTICLES

(75) Inventor: Seichin Kinuta, Tochigi (JP)

(73) Assignee: Optnics Precision Co., Ltd., Tochigi (JP)

( * ) Notice: Subject to any disclaimer, the term of this patent is extended or adjusted under 35 U.S.C. 154(b) by 176 days.

(21) Appl. No.: 12/754,665

(22) Filed: Apr. 6, 2010

(65) Prior Publication Data

US 2011/0056873 A1 Mar. 10, 2011

(30) Foreign Application Priority Data

Sep. 7, 2009 (JP) ..... 2009-206057
Sep. 18, 2009 (JP) ..... 2009-217027

(51) Int. Cl.
*B07B 1/46* (2006.01)

(52) U.S. Cl. ..... 209/397; 209/931

(58) Field of Classification Search ..... 209/392, 209/397, 931
See application file for complete search history.

(56) References Cited

U.S. PATENT DOCUMENTS

| | | | | | |
|---|---|---|---|---|---|
| 170,471 | A | * | 11/1875 | Crocker | 209/269 |
| 255,325 | A | * | 3/1882 | Castler | 209/397 |
| 671,780 | A | * | 4/1901 | Smith | 209/397 |
| 1,606,545 | A | * | 11/1926 | Van Saun | 241/72 |
| 5,638,960 | A | * | 6/1997 | Beuermann et al. | 209/397 |
| 7,017,754 | B2 | * | 3/2006 | Sato et al. | 209/397 |

FOREIGN PATENT DOCUMENTS

| | | | |
|---|---|---|---|
| JP | 6-170160 | A | 6/1994 |
| JP | 11-047693 | A | 2/1999 |
| JP | 11-347491 | A | 12/1999 |
| JP | 2006-122826 | A | 5/2006 |
| JP | 2006281742 | A * | 10/2006 |

* cited by examiner

*Primary Examiner* — Joseph C Rodriguez
(74) *Attorney, Agent, or Firm* — SOLARIS Intellectual Property Group, PLLC

(57) ABSTRACT

This invention aims to enhance efficiency of a sieve and to greatly improve productivity of a sifting operation. There is provided a sieve comprising a metal plate including long holes, wherein the long holes are plurally provided such that lines extending in length directions thereof cross one another.

12 Claims, 13 Drawing Sheets

SIEVE, SIFTING DEVICE, SOLDER BALLS, AND METHOD OF SIFTING SPHERICAL PARTICLES

CROSS-REFERENCE TO RELATED APPLICATION

This application is based on and claims priority under 35 USC 119 from Japanese Patent Application No. 2009-206057 filed on Sep. 7, 2009 and Japanese Patent Application No. 2009-217027 filed on Sep. 18, 2009, the disclosures of which are incorporated by reference herein.

BACKGROUND

1. Technical Field

The present invention relates to a sifting device provided with a sieve made of metal that has excellent classification efficiency, specifically proposes an arrangement of plural holes provided in the sieve, and relates to a sifting device that may enhance efficiency of the sieve and may greatly improve productivity of sifting operations.

2. Related Art

Operation rates of sieves in sifting devices that efficiently sift spherical particles are known to be an important technological factor directly affecting overall industrial productivity. In particular, efficiently sifting spherical particles that are close to perfectly circular, for example, solder balls, is a very important matter in relation to cost, quality and so forth.

Heretofore, shapes of holes in sieves that constitute sifting devices have mostly been circular or square. Moreover, positions of the holes have often been arranged at square grid positions or, more rarely, arranged to be at the points of triangles, and in either case have been arranged uniformly, as what are known as sieve meshes.

When such a sieve mesh is used, the sieve is driven during a sifting operation in a vertical direction or a lateral direction, or alternatively radial directions or the like, and is constantly subjected to oscillations. The object of this oscillation operation is for the particles to touch against the holes of the sieve and then slip downward through the holes as quickly as possible.

However, with vertical oscillations, the particles jump about at the edges of the sieve holes, and may not pass through the holes as hoped. Further, with oscillations to front, rear, left and right, referred to as two-dimensional horizontal oscillations, depending on the speeds and acceleration thereof, there are many opportunities for the particles to pass upward from the holes and therefore the particles may not be efficiently sifted. Further still, when the shapes of the sieve holes are close to the related art squares or perfect circles, that is, when the holes are circumscribed by shortest arcs, the particles stick so as to fill the cavities, and the holes become clogged.

A mechanism by which the particles pass through the holes is that the oscillating particles approach and touch the hole walls, are caught on edge portions of the hole walls, and then fall down. Thus, the longer the lengths of the hole walls through which the particles are acting to pass, the more opportunities there are for the particles to pass through, and the more easily the particles may pass through. Therefore, in a common related art sieve mesh, it is uncertain that there are sufficient chances for particles moving in accordance with lateral direction forces in the plane of the mesh to pass through the holes, and sifting operations are not efficient.

When sifting particles of the order of 20 μm or less, with which the phenomenon of the particles jumping upward occurs, applying positive pressure to the particle side while simultaneously applying negative pressure to the sifted side, such that the sifting operation becomes smoother, is a useful technique. However, a phenomenon then occurs of particles that are temporarily caught in the holes being difficult to remove from the holes, because of the force of the negative pressure, and suchlike. Thus, holes in related art sieve meshes are prone to clogging, and this is not efficient.

In response to this problem, for example, Japanese Patent Application Laid-Open (JP-A) No. 06-170160 proposes a powder separation and removal device in which the shapes of holes in a sieve are made to be long holes, which enhances separation efficiency when sifting powder.

Further, JP-A No. 2006-122826 proposes a sieve for sifting to leave microspheres with a target diameter a, in which the shapes of the holes are rectangular shapes with short sides b whose lengths are 0.9a or less and long sides c whose lengths are greater than a.

Similarly, JP-A No. 11-347491 and JP-A No. 11-47693 propose sieves in which the shapes of the holes are long holes.

However, in the above-mentioned patent references, because the plural long holes formed in each sieve are parallel with one another, when particles are sifted by at least two-dimensional horizontal oscillations, a classification rate is slower in one or other of the oscillation directions.

As indicated above, with related art sieves, numerous investigations have been advanced into making particles slip through the holes and fall down as quickly as possible, preventing clogging of the holes in the sieve meshes, and so forth. However, there is still no definitive means for making sifting operations more efficient.

The present invention is proposed in consideration of the circumstances described above, and the main object is to provide a sieve capable of enhancing sifting efficiency and greatly improving productivity of sifting operations.

SUMMARY

A first aspect is that a sieve comprising a metal plate including long holes, wherein the long holes are plurally provided such that lines extending in length directions thereof cross one another.

A second aspect is that the sieve, wherein the long holes are plurally provided such that the lines extending in the length directions thereof are orthogonal to one another.

A third aspect is that the sieve, wherein a width of the long holes is equal to a diameter of spherical particles to be classified.

A fourth aspect is that the sieve, wherein a cross section of the long holes is a mortar shape such that a width of the long holes at a front face side of the sieve is wider than a width of the long holes at a rear face side of the sieve, the width of the long holes at the rear face side of the sieve being equal to the diameter of the particles.

A fifth aspect is that the sieve, wherein lines extending in the length directions of the long holes are orthogonal to length direction midpoints of others of the long holes.

A sixth aspect is that the sieve, wherein corner portions of the long holes are formed with fillets.

A seventh aspect is that the sieve, wherein at least one of nickel and a nickel alloy is used in the metal plate.

An eighth aspect is that the sieve, wherein fluorocarbon particles of 0.1 to 2 μm have been composite-electrodeposited with nickel plating at a surface of the metal plate.

A ninth aspect is that the sieve, wherein fluorocarbon particles have been composite-electrodeposited with nickel plating, to a thickness of 1 μm to 30 μm at both of length direction hole walls of the long holes.

A tenth aspect is that a sifting device wherein the sieve is oscillated by an oscillation unit that oscillates at least in two horizontal axis directions.

An eleventh aspect is that a plurality of solder balls that have been classified by the sifting device, wherein a rate of occurrence, in the plurality of solder balls, of solder balls with damage at surfaces thereof is less than 0.1%.

A twelfth aspect is that the solder balls, wherein a rate of occurrence, in the plurality of solder balls, of solder balls with discoloration at surfaces thereof is less than 0.1%.

A thirteenth aspect is that a method of sifting spherical particles comprising:

sifting spherical particles using a sifting device; and obtaining the spherical particles that have passed through the long holes in the sifting.

That is, the present invention may enhance sieve efficiency and greatly improve the productivity of sifting operations by constituting a meshed sieve of metal, applying ingenuity to the shapes of the holes, improving the arrangement of the holes, and arranging lines of the holes in accordance with oscillation movements.

Specifically, the shapes of the holes in the sieve are provided as flat ovals or rectangles or, further, as long holes with infected shapes. Moreover, these long holes are characterized by being arranged such that lines extending along respective length directions thereof cross one another.

In the present invention, a plate-form sieve in a sifting device is fabricated of metal, the shapes of holes that sift spherical particles are formed as long holes, and the long holes are plurally provided such that a line extending in the length direction of a long hole is made orthogonal to a length direction of others of the long holes. Thus, when particles are being classified, even if the sieve is oscillated in a number of oscillation directions, it is easy for the particles to pass through the long holes, and the classification rate is increased. Therefore, an operation rate of the sieve may be enhanced. In particular, the classification rate is further increased when the long holes are plurally provided such that the lines extending in the length directions are orthogonal to the length directions of others of the long holes.

Moreover, the operational efficiency of the sieve may be made particularly effective by making widths of the long holes equal to the diameter of the particles to be classified or at least the diameter of the particles to be classified, making the lines extending in the length direction of the long holes orthogonal to length direction midpoints of others of the long holes, and forming corner portions of the long holes of the sieve with filleting. In particular, by forming corner portions of the long holes of the sieve to have roundness, an additional effect may be provided in that cracking or the like that is caused by the sieve being subjected to mechanical oscillations and mechanically fatigued and that damages the sieve may be prevented.

The sieve is fabricated by electroforming. Specifically, using nickel or a nickel alloy, fluorocarbon particles of 0.1 μm to 2 μm are composite-electrodeposited with nickel plating at the surface of the sieve, and fluorocarbon particles are additionally composite-electrodeposited with nickel plating up to a thickness of 1 μm to 30 μm from both the length direction hole walls of each long hole in the sieve. Therefore, by controlling and carrying out a series of operations to fabricate, for example, a 10 μm thick sieve from an electrocast base plate by composite electrodeposition of 0.1 μm to 2 μm fluorocarbon particles with nickel plating, then peeling a nickel mesh from the surface of the electrocast base plate, and then additionally performing composite electrodeposition of fluorocarbon particles with nickel plating up to a thickness of 1 μm to 30 μm from the two length direction hole walls of each long hole in the sieve, the size of the long holes may be controlled while the thickness of the sieve is assured. Thus, the thickness of the sieve mesh may be thoroughly assured in relation to a proportional area of the long holes. Furthermore, because the fluorocarbon particles are additionally composite-electrodeposited with the nickel plating up to a thickness from 1 μm to 30 μm at the two length direction hole walls of each long hole in the sieve, cross-sectional shapes of the long holes have narrow depth direction central portions. Consequently, durations of contact with the insides of the hole walls when the particles to be classified are passing through the long holes are minimized, pass-through durations may be minimized, and the operational efficiency of the sieve may be made even more effective. The composite electrodeposition of the fluorocarbon particles in the nickel plating has effects of improving smoothness of the surfaces of the sieve, and of enhancing abrasion resistance and greatly extending the lifetime of the sieve.

In addition, because the sieve is oscillated by the oscillation unit, the particles may slip through the holes and fall down as quickly as is possible after the particles come into contact with the holes of the sieve, and the operational efficiency of the sieve may be made still more effective.

BRIEF DESCRIPTION OF THE DRAWINGS

Exemplary embodiments of the present invention will be described in detail based on the following figures, wherein.

DETAILED DESCRIPTION

Herebelow, a number of exemplary embodiments of a sifting device relating to the present invention are described on the basis of the drawings.

Figure 1:
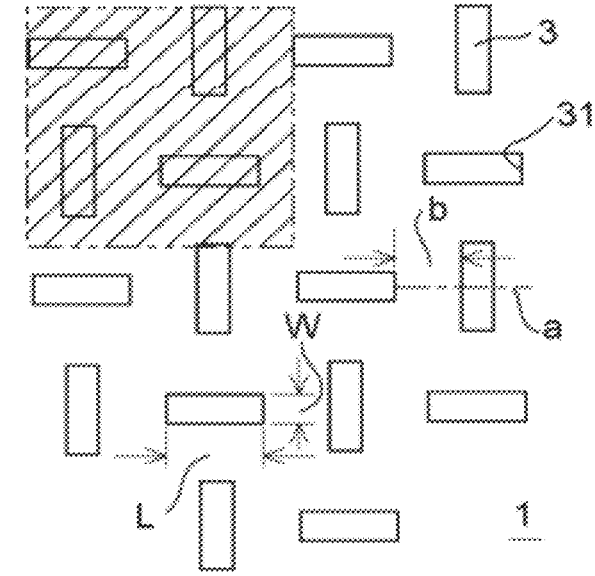
FIG. 1 is a descriptive view describing an arrangement of long holes in a sieve relating to a first exemplary embodiment of the present invention.
Figure 2:
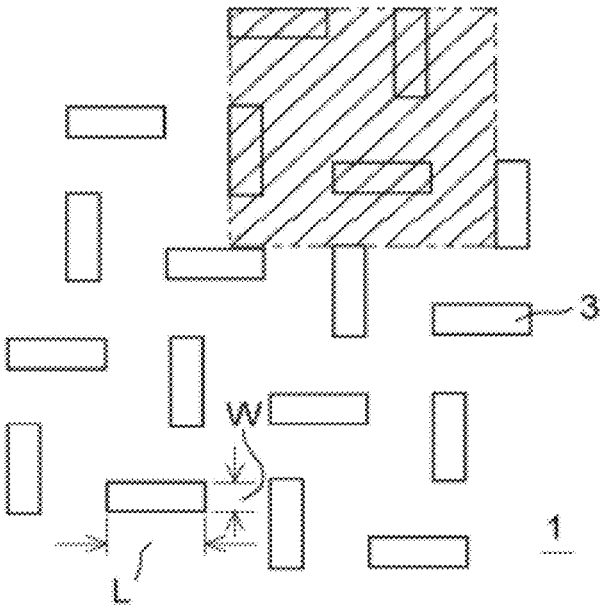
FIG. 2 is a descriptive view describing an arrangement of long holes in a sieve relating to a second exemplary embodiment of the present invention.
Figure 3:
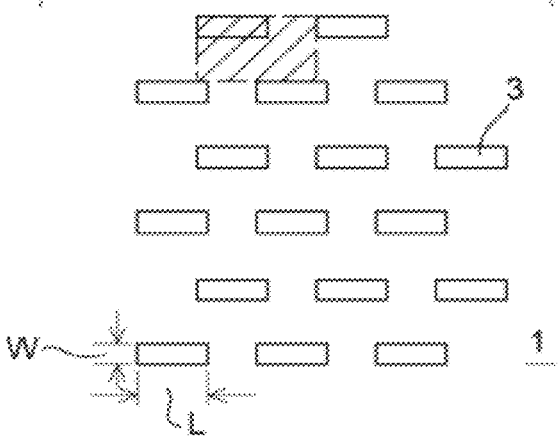
FIG. 3 is a descriptive view describing an arrangement of long holes in a sieve of a sifting device of a first comparative example.
Figure 4:
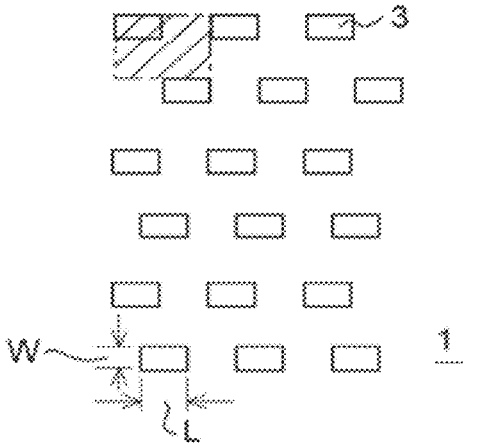
FIG. 4 is a descriptive view describing an arrangement of long holes in a sieve of a sifting device of a second comparative example.
Figure 5:
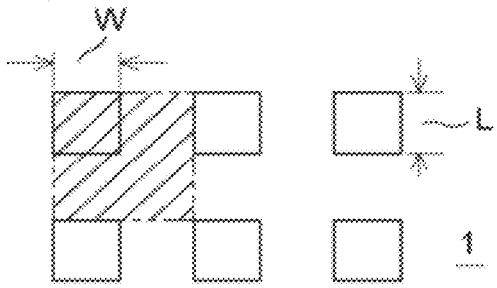
FIG. 5 is a descriptive view describing a sieve mesh in which the holes of a related art sieve are provided with square shapes and in a square grid.
Figure 6:
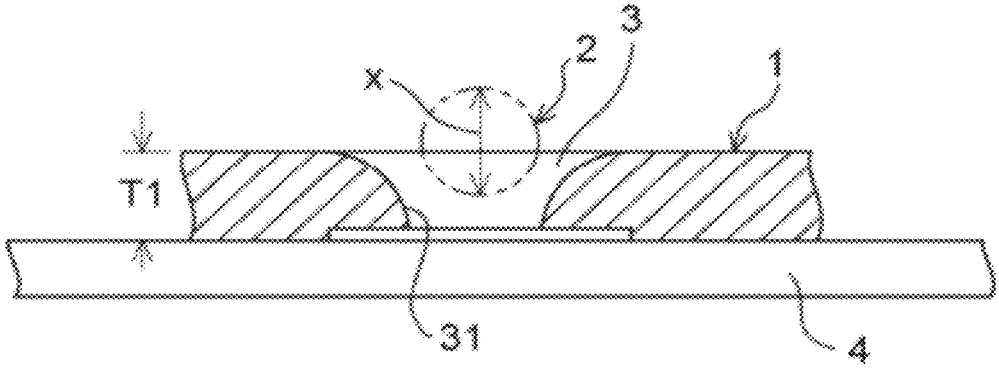
FIG. 6 is a sectional view in which a long hole of a sieve relating to the first exemplary embodiment or second exemplary embodiment of the present invention is cut in a depth direction.
Figure 7:
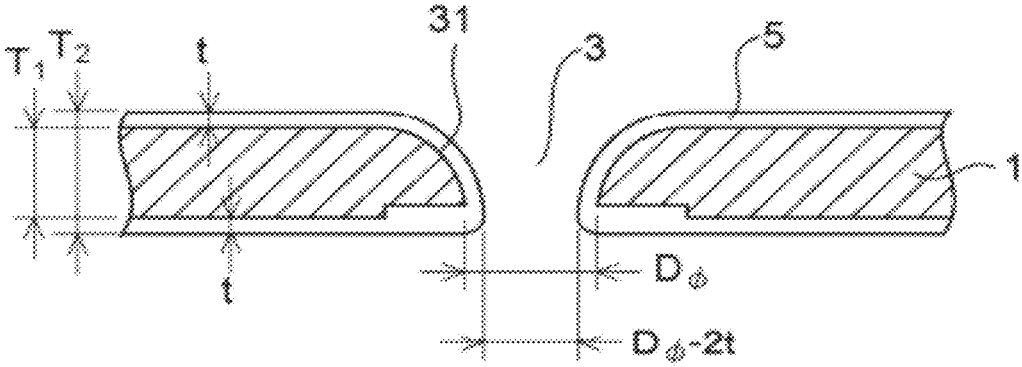
FIG. 7 is a descriptive view illustrating dimensional relationships of the sieve and long hole relating to the first exemplary embodiment or second exemplary embodiment of the present invention.

FIG. 1 is a descriptive view describing an arrangement of long holes in a sieve relating to a first exemplary embodiment of the present invention, FIG. 2 is a descriptive view describing an arrangement of long holes in a sieve relating to a second exemplary embodiment of the present invention, FIG. 3 is a descriptive view describing an arrangement of long holes in a sieve of a sifting device of a first comparative example, FIG. 4 is a descriptive view describing an arrangement of long holes in a sieve of a sifting device of a second comparative example, FIG. 5 is a descriptive view describing a sieve mesh in which the holes of a related art sieve are provided with square shapes and in a square grid, FIG. 6 is a sectional view in which a long hole of a sieve relating to the first exemplary embodiment or second exemplary embodiment of the present invention is cut in a depth direction, and FIG. 7 is a descriptive view illustrating dimensional relationships of the sieve and long hole relating to the first exemplary embodiment or second exemplary embodiment of the present invention.

First Exemplary Embodiment

As illustrated in FIG. 1, a plate-form sieve 1 of a sifting device relating to the present invention (the first exemplary embodiment) is fabricated of a metal, for example, nickel or a nickel alloy, and has long holes 3 with hole shapes that sift, for example, solder balls 2 illustrated in FIG. 6. The long holes 3 are plurally provided in the sieve 1 such that lines extending in the length directions thereof cross length direction midpoints a of others of the long holes 3. A spacing b of the long holes 3 is set to 3 times to 5 times a diameter x of the solder balls 2 to be classified, for example, 3 times, and length direction lengths L of the long holes 3 are set to 3 times the diameter x of the solder balls 2 to be classified. Further, a width W of the long holes 3 is set to equal the diameter x of the solder balls 2 to be classified The diameter x of the solder balls 2 to be classified in the first exemplary embodiment is 67 μm. A thickness T1 of the sieve 1 is 35 μm.

The sieve 1 is fabricated by electroforming, and fluorocarbon particles of 0.1 μm to 2 μm are composite-electrodeposited with nickel plating on the surface of the sieve 1 to, for example, 10 μm thickness. Fluorocarbon particles are additionally composite-electrodeposited with nickel plating to a thickness of 1 μm to 30 μm (preferably a thickness of 1 μm to 20 μm) toward a center region from length direction hole walls 31 of each long hole 3 of the sieve 1, as illustrated in FIG. 6, such that the thickness progressively increases along the depth direction of the long hole 3. Thus, the long hole 3 has a substantially semi-circular mortar shape if seen in cross section.

When a sifting device equipped with the sieve 1 relating to the present invention is operated, the sieve 1 is oscillated by an oscillation unit providing a predetermined frequency and amplitude, performing classification of the solder balls 2 and conducting a sifting operation.

Accordingly, because the provided holes are the above-described long holes 3, the sieve 1 of the present invention may assure a high hole opening ratio, and greatly enhances an operational efficiency of sifting. Moreover, because the spacing b at which the long holes 3 are arranged is set to 3 times the diameter of the solder balls 2 to be classified and a suitable opening ratio is provided, a case in which the long holes 3 being densely concentrated close to one another leads to a weakening of the sieve 1 is avoided, and operational efficiency of the sieve is optimized. Further, the long holes 3 of the sieve 1 are plurally provided such that the lines extending in the length directions of the long holes 3 of the sieve 1 are orthogonal to the length direction midpoints a of others of the long holes 3. With this arrangement of the long holes 3, falling rates are most excellent. The sieve 1 is fabricated with hole diameters of the long holes 3 being controlled by the electroforming. Thus, the length direction hole walls 31 of the long holes 3 form the sectional view mortar shapes that bulge along the depth direction of the long holes 3, and the hole diameters of the long holes 3 provide minimum resistance to the solder balls 2 passing through and falling down.

Second Exemplary Embodiment

As illustrated in FIG. 2, the sieve 1 of a sifting device of the second exemplary embodiment has a structure that differs from the first exemplary embodiment in that the long holes 3 that are plurally provided in the sieve 1 are formed such that the lines extending in the length directions thereof are orthogonal to arbitrary positions in the length directions of others of the long holes 3.

Now, a method of fabricating the sieve 1 of the above-described first exemplary embodiment or second exemplary embodiment using electroforming is described on the basis of FIG. 6.

In the electroforming described below, generally, bringing holes closer to other holes is sufficient as a method for raising a hole opening ratio. In practice however, a result of neighboring holes being made denser and dividing walls therebetween becoming thinner is that strength of the sieve 1 falls and cannot withstand usage. Accordingly, if adjoining walls (the hole walls 31 of the long holes 3) are made thicker along the depth direction and an increase in aspect ratio (a ratio of the depth to the width) is attempted, a thickness T1 (in the depth direction of the long holes 3) becomes relatively larger when the aspect ratio is increased, functionality of the sieve is affected, and a falling rate of the solder balls 2 slows or chances of clogging partway down the long holes 3 increase. The electroforming described below solves this issue.

When the sieve 1 is fabricated by electroforming, generally, the long holes 3 broaden laterally above the thickness of a resist, and consequently the long holes 3 illustrated in FIG. 6 are buried when the sieve 1 grows in the depth direction. Therefore, in the process of electro-forming, after a nickel mesh with a thickness in the order of 2 to 10 μm, for example, 10 μm, is electrodeposited at the surface of the sieve 1, this nickel mesh is peeled from the surface of a base plate 4 of the sieve 1. Then, as illustrated in FIG. 7, fluorocarbon particles are additionally composite-electrodeposited with nickel plating on both faces of the sieve 1.

Thus, the length direction hole walls 31 of the long holes 3 are formed in the mortar shapes in sectional view, bulging along the depth direction of the long holes 3. At this time, the hole diameters of the long holes 3 are controlled so as to form holes through which the solder balls 2 will pass while falling down, given that a thickness t of an additional electrodeposition 5 with nickel plating is at least 2 μm, and so as to provide minimum resistance. A thickness T1 of the sieve 1, a thickness T2 of the sieve 1 after the additional electrodeposition and the thickness t of the additional electrodeposition 5 have the relationship T2=T1+2t. The electrodeposition thickness t at the length direction hole walls 31 of the long holes 3 is equivalent to an amount that narrows the diameter Dø of the long holes 3 by −2t when the electrodeposition proceeds.

The nickel plating with which the fluorocarbon particles are composite-electrodeposited is preferably high-gloss nickel, in order to improve smoothness of the surface of the sieve 1 and keep friction when the solder balls 2 are falling through as low as possible.

Here, it is acceptable if the composite electrodeposition toward the central portion from the length direction hole walls of the long holes 3 gives a thickness of 1 to 60 μm in sum for the two hole walls 31, and 1 to 40 μm is preferable. Accordingly, abrasion resistance is enhanced and the lifetime of the sieve 1 is greatly extended.

Below, results of performance testing of a sifting device relating to the present invention are described in outline.

<Operational Efficiency>

Performances of the first exemplary embodiment illustrated in FIG. 1, the second exemplary embodiment illustrated in FIG. 2, the first comparative example illustrated in FIG. 3, the second comparative example illustrated in FIG. 4 and the third comparative example illustrated in FIG. 5 were compared, with times required for particles (the solder balls 2) to pass through the sieve 1, recovered weights of the solder balls 2, and hole opening ratios of the sieve 1 serving as indices.

As illustrated in FIG. 1 to FIG. 5, the difference between the first comparative example or second comparative example and the first exemplary embodiment or second exemplary embodiment is the arrangement of the long holes 3, and the difference between the first comparative example and the second comparative example is the size (aspect ratio) of the long holes 3. A third comparative example uses a representative related art example of the sieve 1 in which the holes have square shapes and are arranged in a square grid.

In all of the exemplary embodiments and comparative examples, the thickness T1 of the sieve 1 is 35 μm, the sieve 1 is fabricated by electroforming of a nickel alloy, and the length direction hole walls of the long holes 3 are formed in shapes that bulge along the depth direction.

In the testing, solder balls 2 with the same particle diameter distribution as solder particles were used; specifically 100 g of the solder balls 2 in which 50 g of particles with particle diameters of from 62 μm up to 67 μm and 50 g of particles with diameters of from 67.1 μm up to 72 μm were mixed. With the object of classifying the solder balls 2 of 67 μm or less, each sieve 1 was stretched over a stainless steel frame 75 mm in diameter and mounted in an ordinary oscillation-type sifting device, and rates of sifting operations were compared. The results are shown in table 1.

The hole opening ratio here refers to a proportional area of the long holes 3 in a unit area, (one side of) the unit area being a cycle of the long holes 3 and gaps b therebetween in each of a longitudinal direction and a lateral direction (the areas shown by shaded regions in FIG. 1 to FIG. 5).

TABLE 1

| | Time needed for particles to pass through | Recovered weight (g) | Hole opening ratio (%) |
|---|---|---|---|
| First exemplary embodiment | 8 m 10 s | 50.1 | 18.75 |
| Second exemplary embodiment | 8 m 23 s | 50.1 | 18.75 |
| First comparative example | 12 m 32 s | 50.1 | 20 |
| Second comparative example | 15 m 21 s | 50.2 | 16 |
| Third comparative example | 16 m 50 s | 50.1 | 25 |

From the results in table 1, it is seen that the sieve 1 of the first exemplary embodiment in FIG. 1 has the shortest passing duration and therefore the fastest passing rate. The recovered weights were all substantially the same, at 50.1 g or 50.2 g. Thus, it was shown that the effects of the long holes 3 significantly influence the sifting rate more than dependency on the hole opening ratio. It was also established, from comparison of the first exemplary embodiment with the second exemplary embodiment, that there is a slight effect on the sifting rate from the arrangement of the long holes 3. From comparison of the first comparative example with the second comparative example, it is established that there is also a slight effect on the sifting rate from the aspect ratio of the long holes 3. Further, it was established that, relative to any of the first to third comparative examples, operational efficiency of the sieve may be greatly enhanced by arranging the long holes 3 as in the first exemplary embodiment or the second exemplary embodiment.

Thus, in the present invention, the plate-form sieve 1 of a sifting device is fabricated by electroforming using a nickel alloy, the shape of holes that sift the solder balls 2 is the shape of the long holes 3, the long holes 3 are plurally provided such that lines extending in the length directions thereof are orthogonal to length direction midpoints a of others of the long holes 3, a width w of the long holes 3 is made equal to the diameter of the solder balls 2 to be classified, and a length L of length direction of the long holes 3 is set to three times the diameter of the solder balls 2. Thus, the present invention may assure a high opening area for an arrangement of the long holes 3 and may make an operation rate of the sieve improvement. In particular, by setting the spacing b to three times the diameter of the particles to be classified and setting a suitable opening ratio, a case of the long holes 3 being concentrated too close to one another leading to a weakening of the mesh of the sieve 1 is avoided, and operational efficiency of the sieve may be optimized for improvement.

In a step of electroforming, the sieve 1 is fabricated by electrodeposition on an upper face of the base plate 4 to a thickness of 10 μm, is then separated therefrom, and a series of steps are controlled and carried out that additionally perform composite electrodeposition of fluorocarbon particles with nickel plating from both sides of the sieve 1 up to a thickness of 1 μm to 30 μm from each of the length direction hole walls 31 of the long holes 3 of the sieve 1. Thus, the size of the long holes 3 may be controlled while the thickness T1 of the sieve 1 is assured, and the thickness of the sieve mesh compared to the proportional area of the long holes may be assured. Further, by the additional composite electrodeposition of the fluorocarbon particles in the nickel plating up to the thickness of 1 μm to 30 μm from each of the length direction hole walls 31 of the long holes 3, the cross-sectional shapes of the long holes 3 are progressively narrowed in the depth direction of the holes. As a result, durations of contact with the length direction hole walls 31 of the long holes, when the particles to be classified are passing through the long holes 3, are minimized, pass-through durations may be minimized, and operational efficiency of the sieve 1 may be made more useful. The composite electrodeposition of the fluorocarbon particles with the nickel plating has effects of improving smoothness of the surfaces of the sieve 1 and of enhancing abrasion resistance and greatly lengthening the lifetime of the sieve 1.

Thus, the present invention may provide a sifting device equipped with the sieve 1 that may enhance efficiency of the sieve and greatly improve productivity of sifting operations.

<Relationship Between Length L and Sifting Rate>

Next, with the arrangement of the long holes 3 of the second exemplary embodiment, the length direction length L of the long holes 3 was altered and the effect of the length L on the sifting rate was evaluated.

In this evaluation, the overall size of the sieve 1 of the second exemplary embodiment was a circular disc with a diameter of 50 mm, and the width W of the long holes 3 was 300 μm. Sieves 1 were respectively prepared with, relative to the width W of the long holes 3 (the same size as the solder balls 2 to be sifted), the length direction length L of the long holes 3 being altered to 1×(300 μm), 2×(600 μm), 3×(900 μm), 5×(1500 μm) and 10×(3000 μm). As the solder balls 2 to be applied for sifting with these sieves 1, two million balls were prepared with diameters of 300 μm and a weight of 200 g. A pressure applied at the front face of the sieve 1 was set to 10 g/cm$^2$.

Here, the opening ratios of the respective sieves 1 were the same, at 40%. The sieve 1 when the length L was at 1× may be considered as being the same as the structure of the third comparative example.

The method of evaluation was that the solder balls 2 were placed on each sieve 1 prepared as described above, and the solder balls 2 were shaken on the surface of the sieve 1 by the application of ultrasonic oscillations. An operation duration of sifting until all the solder balls 2 passed through the long holes 3 of the sieve 1 was measured, and a sifting rate was calculated.

Figure 8:
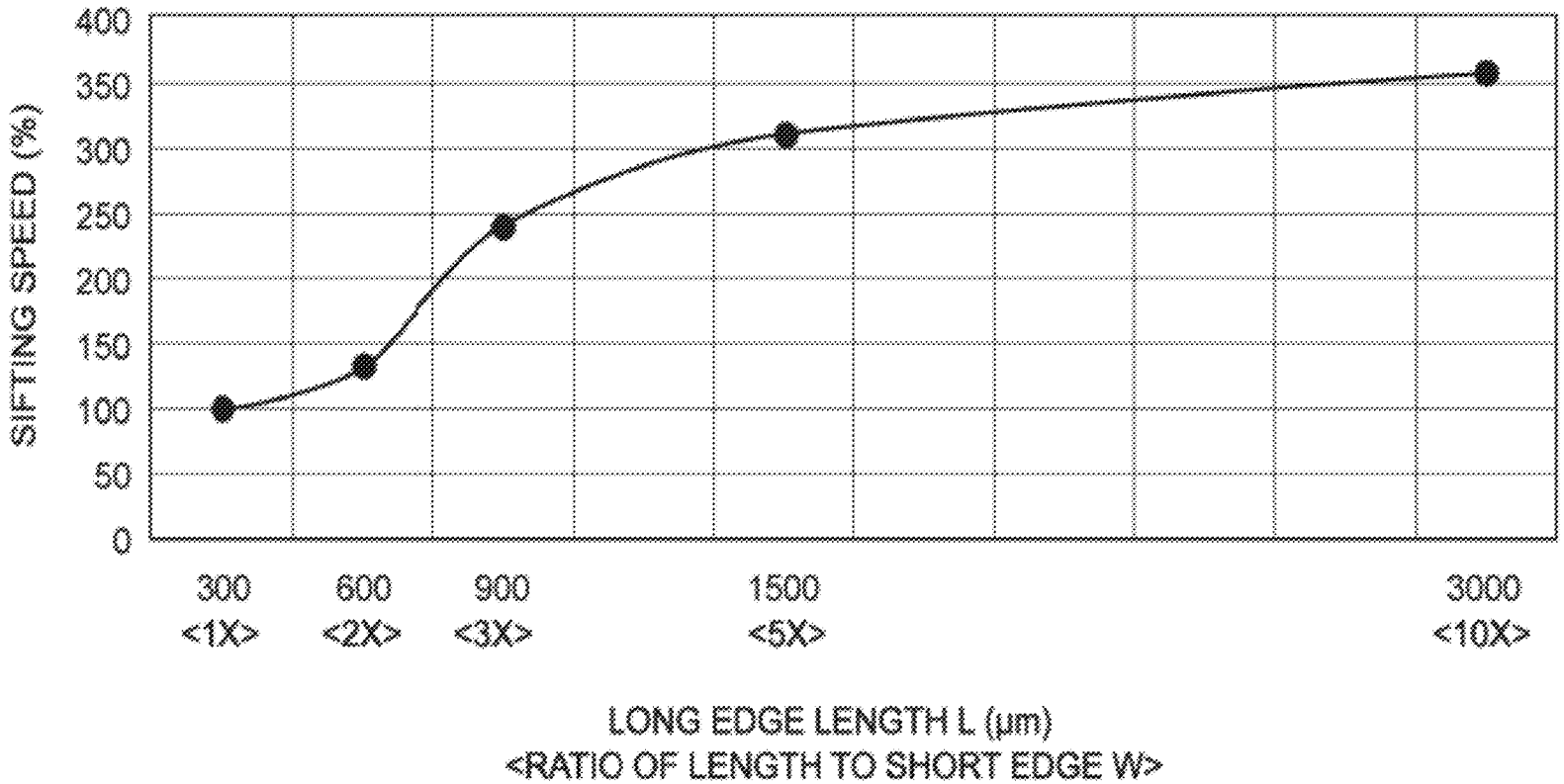
FIG. 8 is a chart illustrating results of evaluating a relationship between a length L in a length direction (a long side) and a sifting rate.

FIG. 8 is a chart illustrating the results of evaluating the relationship between the length L of the length direction (long sides) and the sifting rate. The sifting rates in FIG. 8 are values relative to a sifting rate (100%) of the sieve 1 in which the long side length L of the long holes 3 and the width W of the long holes 3 are 300 μm (for convenience, the holes of the sieves 1 are referred to as the long holes 3, even though in this case the holes have square shapes).

From the evaluation results shown in FIG. 8, it was clear that the longer the length of the long sides of the long holes 3, the higher the rate of sifting. It was also seen that when the length L of the long sides is set to 3 times the width W, the sifting rate increases sharply compared to the cases in which the length L of the long sides is at 1 times or 2 times, but that the rate of increase in the sifting rate slows beyond 3 times. From the above results, it can be said that, taking account of the strength of the sieve 1, the length L of the long sides is preferably more than 2× and less than 5×, and is more preferably in the vicinity of 3×.

<Effects on the Solder Balls 2>

Next, effects of the arrangement of holes in the sieve 1, the hole shapes and the like on the solder balls 2 that have been applied to the sieve were evaluated.

Figure 9:
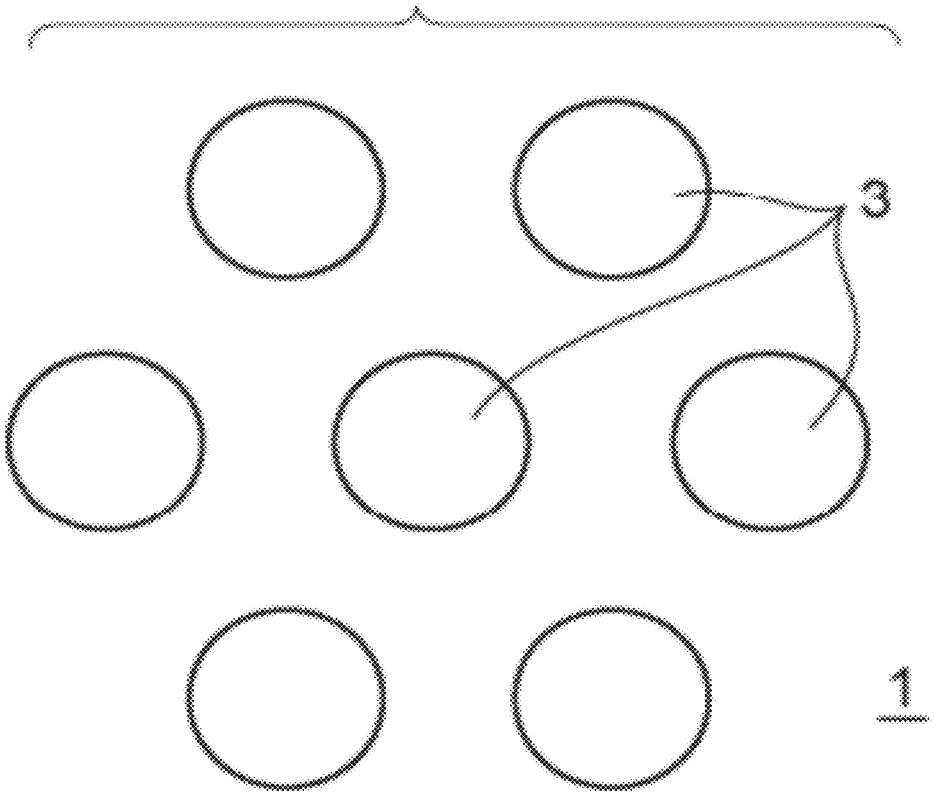
FIG. 9 is a descriptive view describing an arrangement of long holes in a sieve of a sifting device of a fourth comparative example.

In this evaluation, the sieve 1 of a fourth exemplary embodiment illustrated in FIG. 9 was used for comparison with the sieve 1 of the second exemplary embodiment. As the solder balls 2 to be applied for sifting with these sieves 1, two million balls were prepared with diameters of 300 μm and a weight of 200 g. A pressure applied at the front face of the sieve 1 was set to 10 g/cm$^2$.

The overall size of the sieve 1 of the second exemplary embodiment was a circular disc with a diameter of 50 mm, the length L of the long holes 3 was 900 μm, three times the diameter of the solder balls 2, and the width W of the long holes 3 was 300 μm, the same as the diameter of the solder balls 2. In the sieve 1 of the fourth comparative example, the shape of the long holes 3 was not long holes, similarly to the third comparative example, but circular shapes of the same size as the diameter of the solder balls 2.

The method of evaluation was that the solder balls 2 were placed on each sieve 1 prepared as described above, and the solder balls 2 were shaken on the surface of the sieve 1 by the application of ultrasonic oscillations. Then, after all the solder balls 2 had passed through the long holes 3 of the sieve 1, a rate of occurrence of solder balls 2 with damage among all the sifted solder balls 2 was ascertained. A rate of occurrence of solder balls 2 with surface discoloration among all the sifted solder balls 2 was also ascertained.

These rates of occurrence were ascertained by inspection of surface conditions of the solder balls 2 using an electron microscope (maker: TOPCON CORPORATION, model number: ABT-60).

Figure 10A:
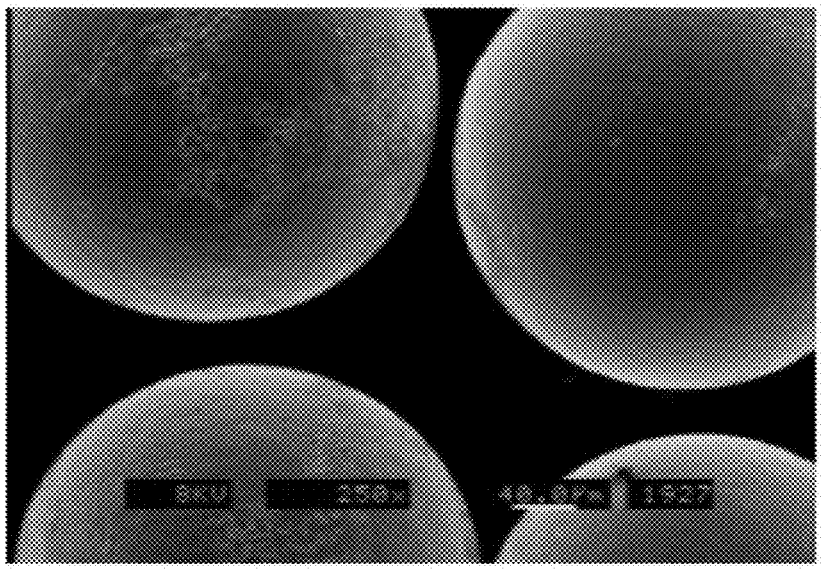
FIG. 10A is an electron micrograph (magnification 250×) of solder balls before sifting with a sieve.
Figure 10B:
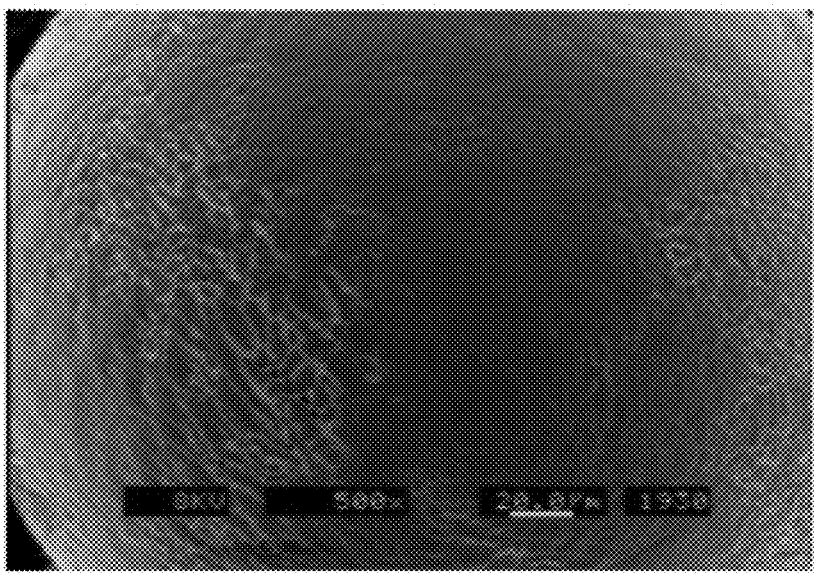
FIG. 10B is a partially enlarged electron micrograph (magnification 500×) of a solder ball shown in FIG. 10A.
Figure 11A:
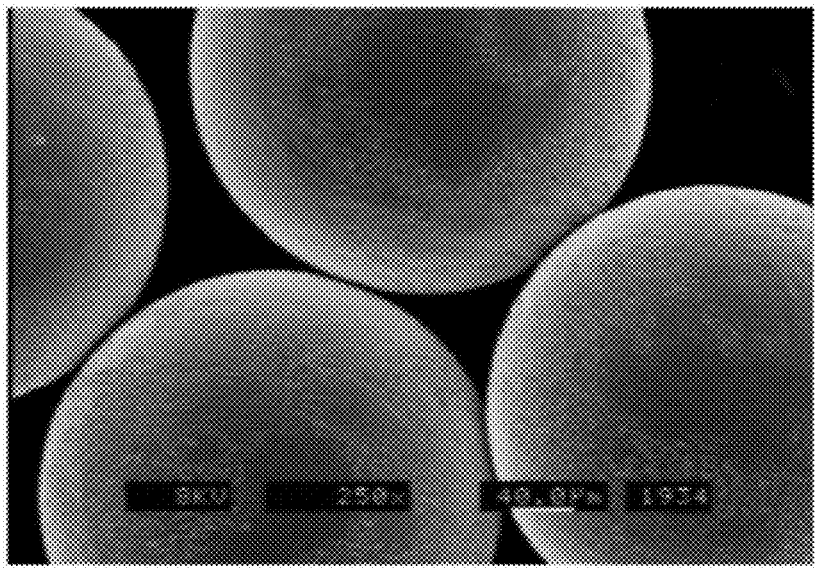
FIG. 11A is an electron micrograph (magnification 250×) of solder balls that have been sifted with the sieve of the second exemplary embodiment.
Figure 11B:
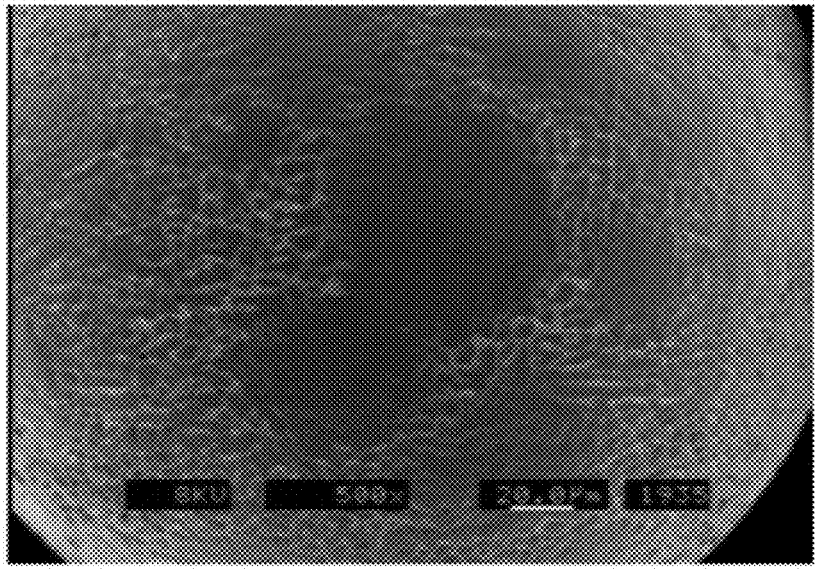
FIG. 11B is a partially enlarged electron micrograph (magnification 500×) of a solder ball shown in FIG. 11A.
Figure 12A:
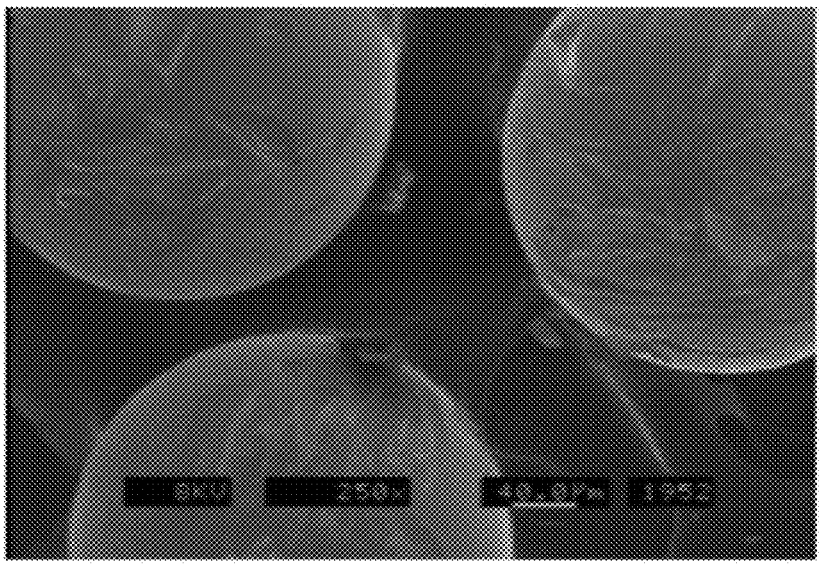
FIG. 12A is an electron micrograph (magnification 250×) of solder balls that have been sifted with the sieve of the fourth comparative example.
Figure 12B:
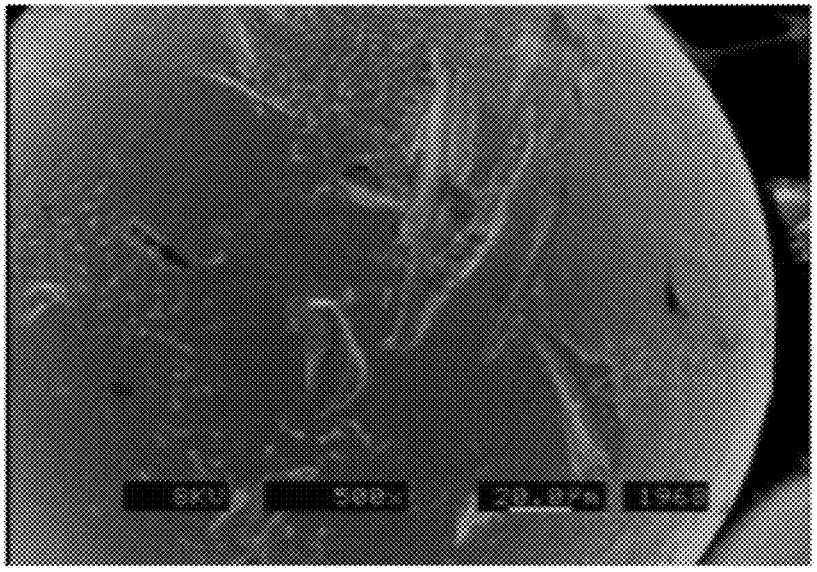
FIG. 12B is a partially enlarged electron micrograph (magnification 500×) of a solder ball shown in FIG. 12A.

Electron micrographs showing surface conditions of the solder balls 2 are reproduced in FIG. 10A to FIG. 12B. FIG. 10A is an electron micrograph (magnification 250×) of the solder balls 2 before sifting with the sieve 1, and FIG. 10B is a partially enlarged electron micrograph (magnification 500×) of a solder ball 2 shown in FIG. 10A. FIG. 11A is an electron micrograph (magnification 250×) of the solder balls 2 that have been sifted with the sieve 1 of the second exemplary embodiment, and FIG. 11B is a partially enlarged electron micrograph (magnification 500×) of a solder ball 2 shown in FIG. 11A. FIG. 12A is an electron micrograph (magnification 250×) of the solder balls 2 that have been sifted with the sieve 1 of the fourth comparative example, and FIG. 12B is a partially enlarged electron micrograph (magnification 500×) of a solder ball 2 shown in FIG. 12A.

As illustrated in FIG. 11A and FIG. 11B, the surfaces of the solder balls 2 sifted by the sieve 1 of the second exemplary embodiment were not inferior to the surfaces of the solder balls 2 before sifting shown in FIG. 10A and FIG. 10B and it was clear that there was no damage or discoloration at all. Therefore, the rates of occurrence of solder balls 2 with damage or discoloration were 0%. For this evaluation, the term "damage" refers to damage that is visible in an electron micrograph at a magnification of 500×, and does not mean that there was no microscopic damage that was not visible. Further, the term "discoloration" refers to discoloration that can be identified with the human eye in electron micrographs at a magnification of 500×, and does not mean that there was no microscopic discoloration that was not identifiable.

In contrast, as illustrated in FIG. 12A and FIG. 12B, it was clear that solder balls 2 with damage to the surface were dotted among the solder balls 2 sifted by the sieve 1 of the fourth comparative example. Accordingly, counting numbers of the solder balls 2 with damage and surveying the rate of occurrence thereof, the rate of occurrence was 7%. In addition, it was clear that solder balls 2 with discoloration at the surface were dotted among the solder balls 2 sifted by the sieve 1 of the fourth comparative example. Accordingly, counting numbers of the solder balls 2 with discoloration and surveying the rate of occurrence thereof, the rate of occurrence was 3%.

The above described evaluation results are summarized and shown in table 2.

TABLE 2

| | Surface damage | Surface discoloration |
|---|---|---|
| Second exemplary embodiment | 0% | 0% |
| Fourth comparative example | 7% | 3% |

<Surface Analysis>

Next, a surface analysis (EDS analysis) was applied to the respective solder balls 2 sifted by the sieve 1 of the second exemplary embodiment and the sieve 1 of the fourth comparative example. An energy dispersion type X-ray analysis device (maker: PHILIPS JAPAN, model number: EDAX DX-4) was used for this analysis.

Figure 13:
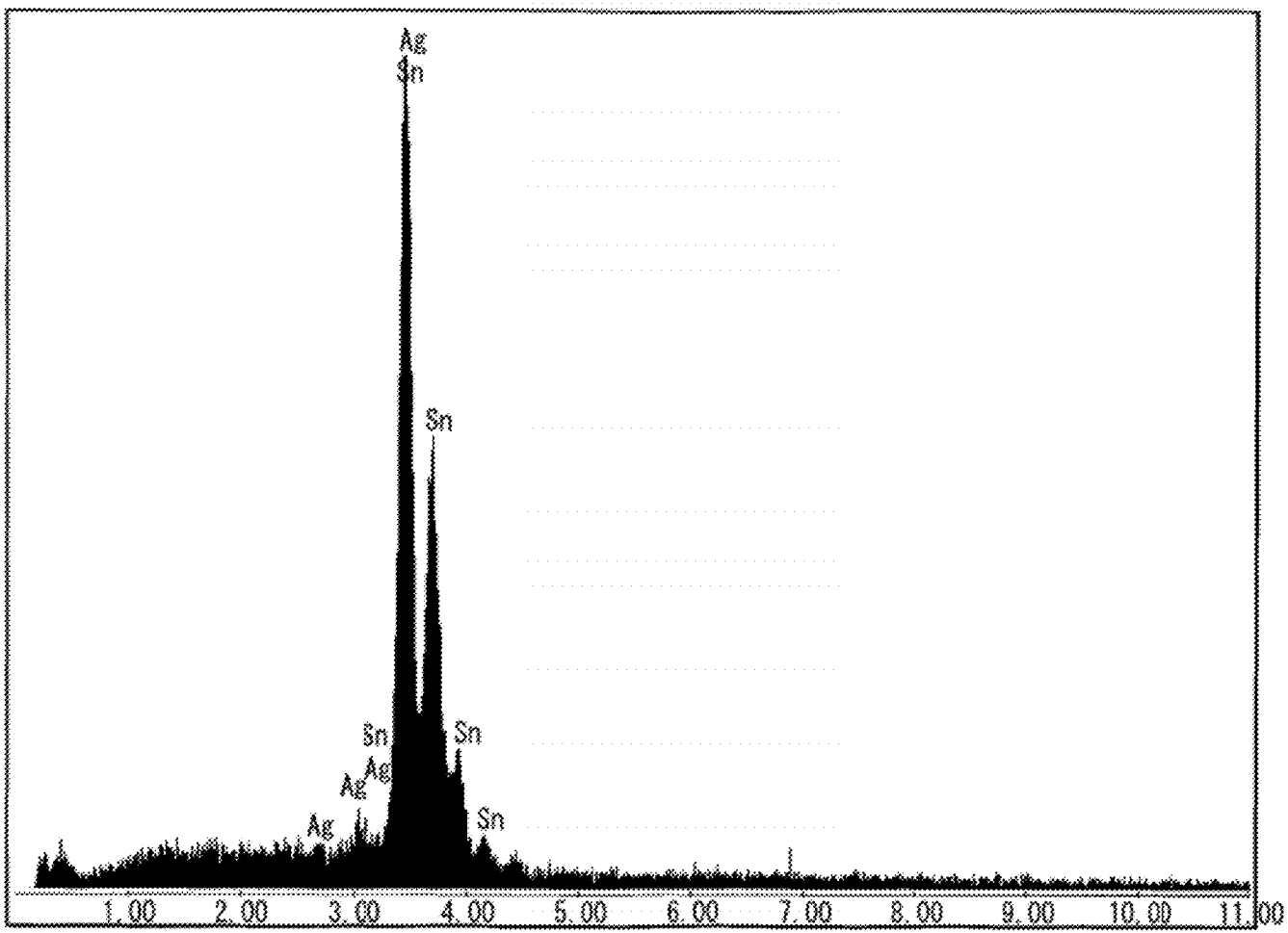
FIG. 13 is a chart illustrating results of performing EDS analysis on solder balls sifted by the sieve of the second exemplary embodiment.
Figure 14:
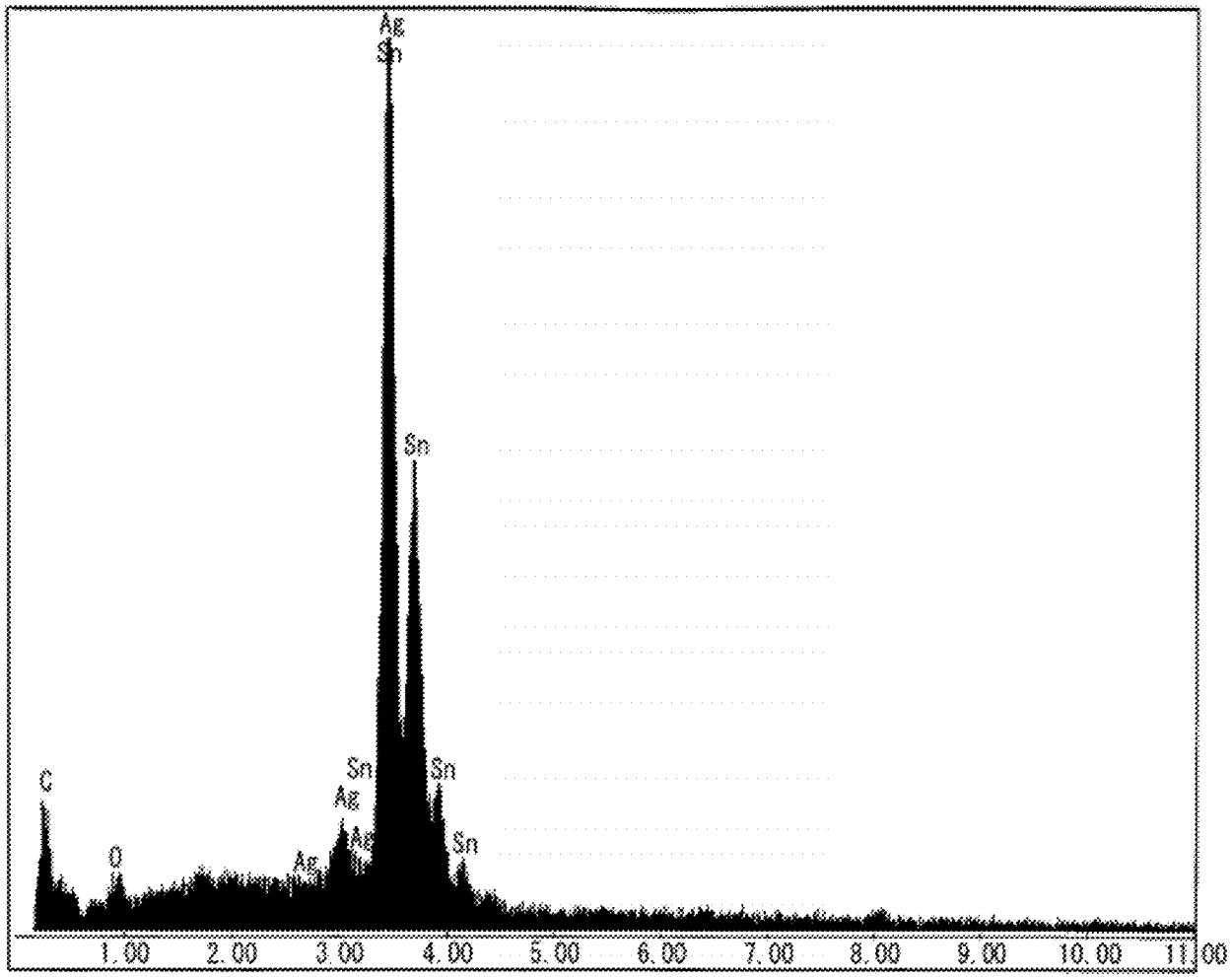
FIG. 14 is a chart illustrating results of performing EDS analysis on solder balls with discoloration that have been sifted by the sieve of the fourth comparative example.

FIG. 13 is a chart illustrating results of performing the EDS analysis on the solder balls 2 sifted by the sieve 1 of the second exemplary embodiment. FIG. 14 is a chart illustrating results of performing the EDS analysis on the solder balls 2 with discoloration sifted by the sieve 1 of the fourth comparative example.

As shown in FIG. 13 and FIG. 14, compared with the surfaces of the solder balls 2 sifted by the sieve 1 of the second exemplary embodiment, weak energy peaks for carbon and oxygen at the light elements end of the spectrum were seen with the solder balls 2 sifted by the sieve 1 of the fourth comparative example. From this, it could be verified that the solder balls 2 sifted by the sieve 1 of the fourth comparative example were discolored by oxidation.

Variant Examples

Hereabove, a number of exemplary embodiments relating to the present invention have been described in detail. However, the present invention is not to be limited by the above embodiments. Numerous design modifications may be applied to the present invention providing they do not depart from the particulars described in the attached claims.

Figure 15A:
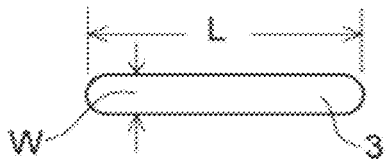
FIG. 15A is a descriptive view exemplifying a variation of shape of the long holes of the sieve of a sifting device of the present invention, which is a descriptive view of a long hole shape in which corner portions are filleted.
Figure 15B:
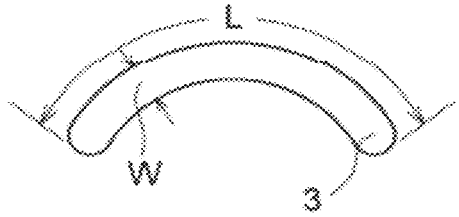
FIG. 15B is a descriptive view exemplifying a variation of shape of the long holes of the sieve of the sifting device of the present invention, which is a descriptive view of a sickle shape.
Figure 15C:
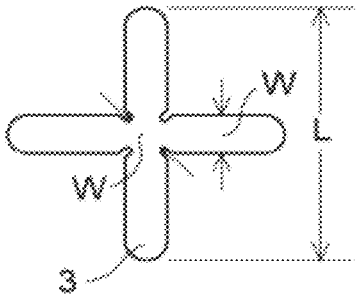
FIG. 15C is a descriptive view exemplifying a variation of shape of the long holes of the sieve of the sifting device of the present invention, which is a descriptive view of a cross shape.
Figure 15D:
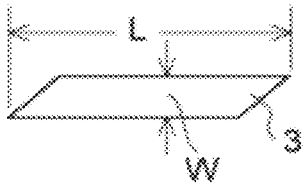
FIG. 15D is a descriptive view exemplifying a variation of shape of the long holes of the sieve of the sifting device of the present invention, which is a descriptive view of a parallelogram shape.
Figure 15E:
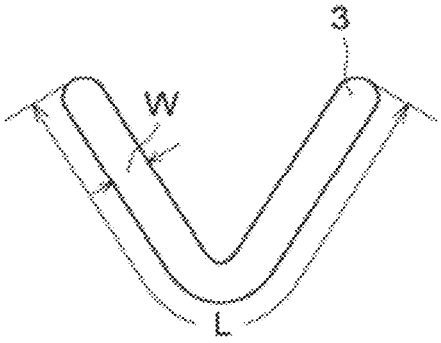
FIG. 15E is a descriptive view exemplifying a variation of shape of the long holes of the sieve of the sifting device of the present invention, which is a descriptive view of a boomerang-shaped long hole.

For example, in a sifting device of the present invention, because the sieve operates in association with oscillations, it is desirable for the shapes of the long holes to have filleting at corner portions as illustrated in FIG. 15A, such that particles are not damaged in a sifting operation. Applying filleting to the whole of the short edges of the long holes is also useful. Because cracking is caused by the sieve being subjected to vertical mechanical oscillations and eventual mechanical fatigue, damage to the corner portions may be prevented by the filleting being applied to the long holes. Further, as illustrated in FIG. 15B, it is not necessary for the length direction sides of the long holes to be straight. If the long sides are instead in a shape which is curved around (a sickle shape), this may, depending on the case, be excellent in terms of use of space.

The effects of the present invention may be provided when the width of the long holes is at least the diameter of the particles to be classified.

Figure 15F:
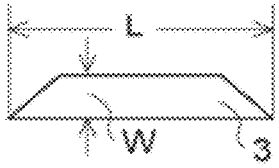
FIG. 15F is a descriptive view exemplifying a variation of shape of the long holes of the sieve of the sifting device of the present invention, which is a descriptive view of a trapezoid-shaped long hole.

The effects of the present invention provided by the exemplary embodiments described above may be obtained even if, as illustrated in FIG. 15C to FIG. 15F, the shapes of the long holes of the sieve in a sifting device of the present invention are a cross shape (FIG. 15C), a parallelogram shape (FIG. 15D), a boomerang shape (FIG. 15E) or a trapezoid shape (FIG. 15F). Thus, sieves may be formed that are capable of enhancing efficiency of the sieves and greatly improving productivity of sifting operations, and, depending on the case, the provision of an excellent effect of high efficiency of sieve operations in terms of use of space may be expected.

In the first and second exemplary embodiments, cases have been described in which the length L of the long holes 3 of the sieve 1 is 3 times the diameter of the particles to be classified. However, the present invention is applicable as long as the length L is larger than the diameter of the solder balls 2, by 2 times, 4 times, 5 times, 6 times or the like.

Further, cases have been described in which the plural long holes 3 of the sieve 1 are provided such that lines extending in length directions thereof are mutually orthogonal. However, for the present invention it is sufficient that the long holes 3 be provided such that the lines extending in the length directions thereof cross one another.

The oscillation unit of the sieve 1 may, besides vertical directions and lateral directions, oscillate the sieve 1 in radial directions or the like. Provided the sieve 1 is oscillated in two horizontal axis directions, any oscillation unit may be employed, including oscillations by hand.

A case has been described in which the rate of occurrence of solder balls with damage or discoloration at the surface in the solder balls 2 sifted by the sieve 1 of the second exemplary embodiment is 0%. However, the present invention is applicable and solder balls may be considered as being the solder balls 2 provided at least that the rate of occurrence is less than 0.1%.

It is not necessary for all of the plural long holes 3 in the sieve 1 to have lines extending in the length directions thereof that cross one another. For example, a plural number of blocks (regions) may be provided in the sieve 1, with the long holes 3 being plurally provided parallel to one another in each block, such that the long holes 3 in one block and the long holes 3 in another block have lines extending in the length directions thereof that cross one another.

Figure 16A:
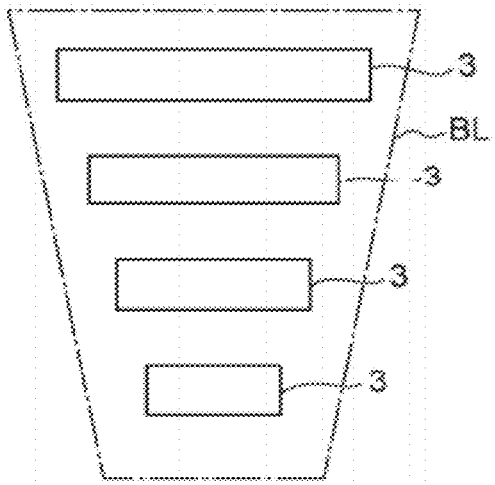
FIG. 16A is a diagram illustrating an example of an arrangement of long holes provided in a block.
Figure 16B:
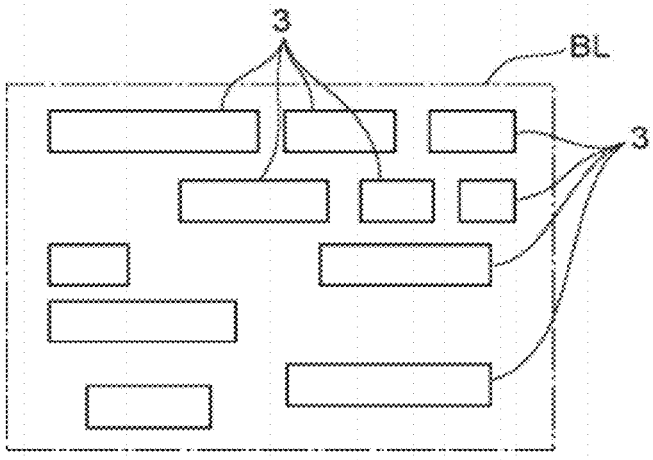
FIG. 16B is a diagram illustrating another example of an arrangement of long holes provided in a block.
Figure 16C:
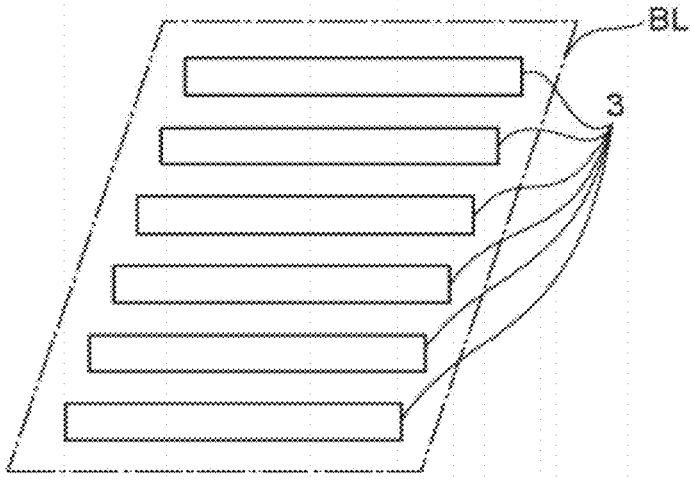
FIG. 16C is a diagram illustrating still another example of an arrangement of long holes provided in a block.
Figure 17A:
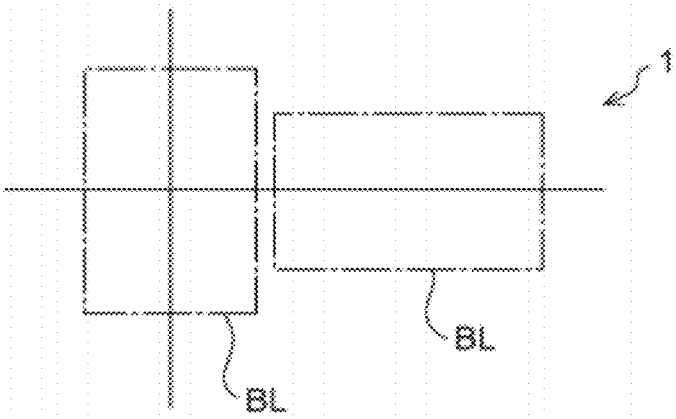
FIG. 17A is a diagram illustrating an example of an arrangement of blocks relative to one another.
Figure 17B:
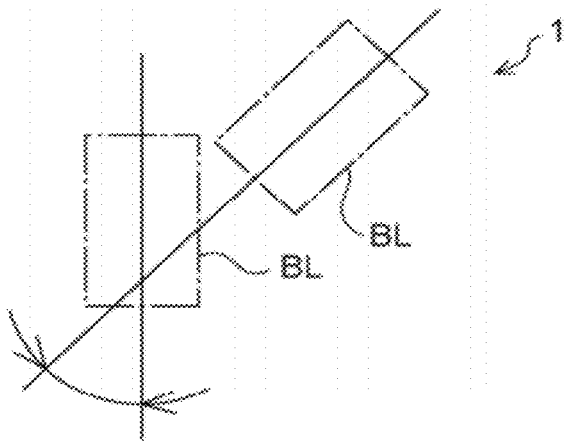
FIG. 17B is a diagram illustrating an example of an arrangement of blocks relative to one another.
Figure 17C:
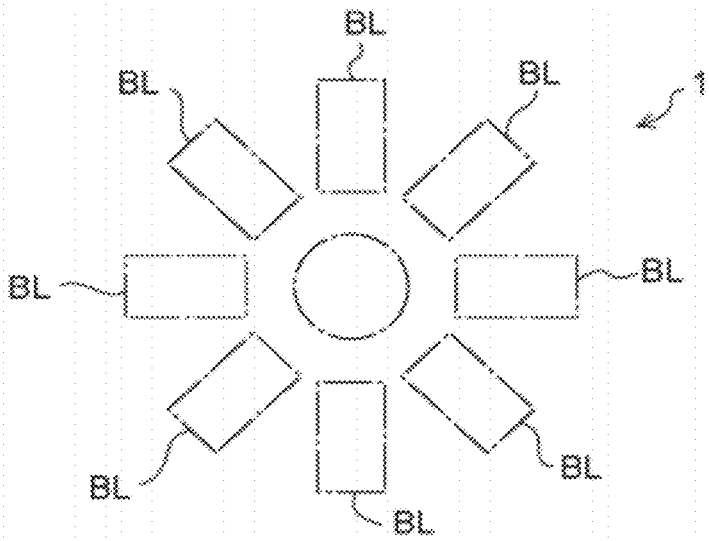
FIG. 17C is a diagram illustrating an example of an arrangement of blocks relative to one another.

Examples are specifically described using FIG. 16A to FIG. 16C and FIG. 17A to FIG. 17C. FIG. 16A is a diagram illustrating an example of an arrangement of long holes provided in a block, FIG. 16B is a diagram illustrating another example of an arrangement of long holes provided in a block and FIG. 16C is a diagram illustrating still another example of an arrangement of long holes provided in a block. FIG. 17A to FIG. 17C are diagrams illustrating examples of arrangements of the blocks relative to one another.

Firstly, as illustrated in FIG. 16A to FIG. 16C, the long holes 3 that are parallel to one another are plurally provided in blocks BL. The length direction lengths L of the long holes 3 in a block BL may be different from one another, and the ratios between the length direction lengths L of the long holes 3 and a width W of the long holes 3 may be arbitrary. The arrangements of the long holes 3 may be regular as in FIG. 16A and FIG. 16C, and random arrangements may be employed as in FIG. 16B.

These blocks BL are plurally provided in the sieve 1, and the blocks BL are arranged such that, for example, as illustrated in FIG. 17A, the lines extending in the length directions of the long holes 3 in one block BL and the lines extending in the length directions of the long holes 3 in another block BL are orthogonal to one another. Further, as illustrated in FIG. 17B, the blocks BL may be arranged such that the lines extending in the length directions of the long holes 3 in one block BL and the lines extending in the length directions of the long holes 3 in another block BL cross one another, and the crossing angles may be arbitrary. Further yet, as illustrated in FIG. 17C, the blocks BL may be arranged in a radial pattern in the sieve 1, and another block BL may be disposed at the middle of this radial pattern. The sizes and shapes of the blocks BL themselves are not to be particularly limited herein.

The present invention is not to be limited to classifying solder balls as in the exemplary embodiments described above, and may be applied to sieves for classifying various particles and materials, such as ball bearings, dummy balls and balls for spacers, glass beads, liquid crystal spacer particles and so forth, and operational performances may be upgraded by raising classification speeds. Therefore, the present invention may contribute to a reduction in cost of particles or a material being classified, and this effect is very significant. In particular, this effect is largest when applied to classifying spherical particles, such as solder balls.

What is claimed is:

1. A sieve comprising a metal plate including long holes,
wherein the long holes comprise a plurality of first long holes in a first length direction and a plurality of second long holes in a second length direction,
wherein lines extending in the first and the second length directions cross one another, and
wherein the first long holes and the second long holes are provided alternately one by one from right to left as well as up and down.

2. The sieve according to claim 1, wherein the long holes are plurally provided such that the lines extending in the length directions thereof are orthogonal to one another.

3. The sieve according to claim 1, wherein a width of the long holes is equal to a diameter of spherical particles to be classified.

4. The sieve according to claim 3, wherein a cross section of the long holes is a mortar shape such that a width of the long holes at a front face side of the sieve is wider than a width of the long holes at a rear face side of the sieve, the width of the long holes at the rear face side of the sieve being equal to the diameter of the particles.

5. The sieve according to claim 1, wherein lines extending in the length directions of the long holes are orthogonal to length direction midpoints of others of the long holes.

6. The sieve according to claim 1, wherein corner portions of the long holes are formed with fillets.

7. The sieve according to claim 1, wherein at least one of nickel and a nickel alloy is used in the metal plate.

8. The sieve according to claim 1, wherein fluorocarbon particles of 0.1 to 2 μm have been composite-electrodeposited with nickel plating at a surface of the metal plate.

9. The sieve according to claim 8, wherein fluorocarbon particles have been composite-electrodeposited with nickel plating, to a thickness of 1 μm to 30 μm at both of length direction hole walls of the long holes.

10. A sifting device wherein the sieve according to claim 1 is oscillated by an oscillation unit that oscillates at least in two horizontal axis directions.

11. A method of sifting spherical particles comprising: sifting spherical particles using a sifting device according to claim 10; and obtaining the spherical particles that have passed through the long holes in the sifting.

12. The sieve of claim 1, wherein the first line in the first length direction of a first long hole intersects an adjacent second long hole in a substantially perpendicular manner.

* * * * *